US011386812B2

(12) United States Patent
Walter

(10) Patent No.: US 11,386,812 B2
(45) Date of Patent: Jul. 12, 2022

(54) FILM STRUCTURE WITH PROTECTION AGAINST MANIPULATION

(71) Applicant: Schreiner Group GmbH & Co. KG, Oberschleissheim (DE)

(72) Inventor: Mark Walter, Unterschleissheim (DE)

(73) Assignee: Schreiner Group GmbH & Co. KG, Oberschleissheim (DE)

( * ) Notice: Subject to any disclaimer, the term of this patent is extended or adjusted under 35 U.S.C. 154(b) by 289 days.

(21) Appl. No.: 16/098,483

(22) PCT Filed: Apr. 28, 2017

(86) PCT No.: PCT/EP2017/060210

§ 371 (c)(1),
(2) Date: Nov. 2, 2018

(87) PCT Pub. No.: WO2017/191051

PCT Pub. Date: Nov. 9, 2017

(65) Prior Publication Data

US 2019/0147775 A1 May 16, 2019

(30) Foreign Application Priority Data

May 3, 2016 (DE) ..... 10 2016 108 216.3

(51) Int. Cl.
*G09F 3/03* (2006.01)
*G09F 3/02* (2006.01)
*G09F 3/00* (2006.01)

(52) U.S. Cl.
CPC ..... *G09F 3/0291* (2013.01); *G09F 3/0341* (2013.01); *G09F 2003/0255* (2013.01);
(Continued)

(58) Field of Classification Search
CPC ..... G09F 3/0291; G09F 3/0341; G09F 2003/0255; G09F 2003/0257;
(Continued)

(56) References Cited

U.S. PATENT DOCUMENTS 6,066,437 A * 5/2000 Kosslinger ..... B32B 7/02 430/297
6,815,147 B2 11/2004 Fischer
(Continued)

FOREIGN PATENT DOCUMENTS

CN 2426854 Y 4/2001
CN 2528071 Y 12/2002
(Continued)

OTHER PUBLICATIONS

International Search Report of PCT/EP2017/060210, dated Jun. 30, 2017.
(Continued)

*Primary Examiner* — Scott R. Walshon
(74) *Attorney, Agent, or Firm* — Collard & Roe, P.C.

(57) ABSTRACT

A film structure with protection against manipulation includes a top film, a laser-inscribable layer which is arranged on the bottom side of the top film, and also a bottom film and a connecting layer for connecting the bottom film to the top film and the laser-inscribable layer. The connecting layer is arranged between the laser-inscribable layer and the bottom film. The film structure has an inscribed region and an uninscribed region. The top film is fused with the bottom film in the inscribed region of the film structure. As a result, it is virtually impossible to separate the top film with the inscribed layer from the bottom film without destruction in the event of a manipulation attempt.

14 Claims, 3 Drawing Sheets

Figure 1:
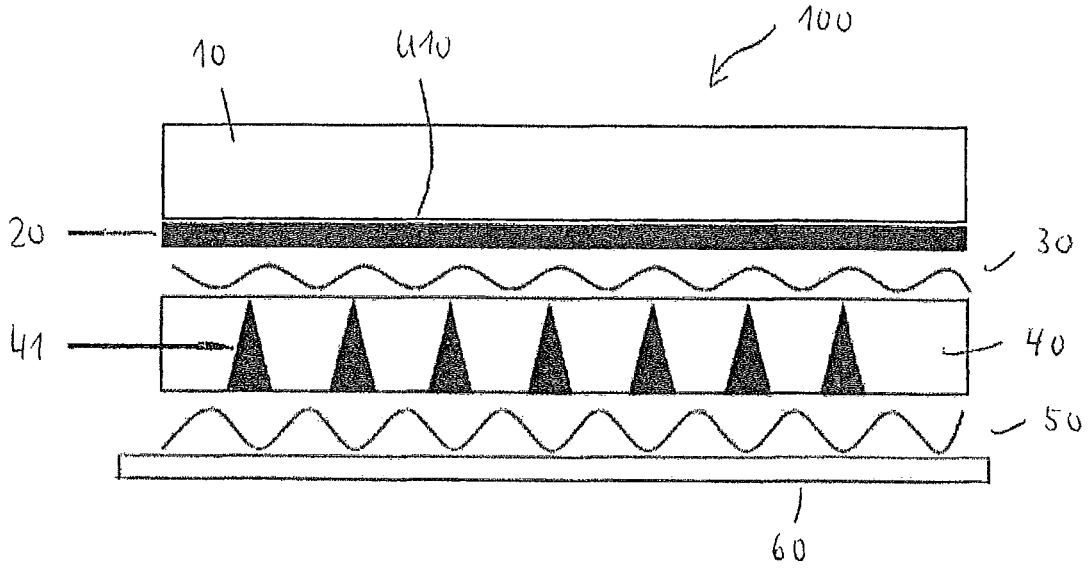

(52) U.S. Cl.
CPC ..... *G09F 2003/0257* (2013.01); *G09F 2003/0276* (2013.01)

(58) Field of Classification Search
CPC . G09F 2003/0276; B41M 5/24; B41M 5/245; G03F 7/202; G03F 7/2053; B42D 25/20; B42D 25/29; B42D 25/455; B42D 25/465
See application file for complete search history.

(56) References Cited

U.S. PATENT DOCUMENTS

| | | | | |
|---|---|---|---|---|
| 7,207,494 | B2 * | 4/2007 | Theodossiou | B41M 3/14 235/487 |
| 7,431,790 | B2 | 10/2008 | Birk | |
| 7,758,079 | B2 * | 7/2010 | Beyer-Meklenburg | B42D 25/41 283/75 |
| 8,336,915 | B2 * | 12/2012 | Christen | B42D 1/002 283/63.1 |
| 8,790,484 | B2 | 7/2014 | Schmidt et al. | |
| 10,017,001 | B2 * | 7/2018 | Chen-Ho | B42D 25/00 |
| 2008/0169638 | A1 * | 7/2008 | Beyer-Meklenburg | B42D 25/435 283/75 |
| 2009/0033085 | A1 * | 2/2009 | Suto | G07D 7/10 283/67 |
| 2009/0035492 | A1 | 2/2009 | Amano et al. | |
| 2014/0197625 | A1 * | 7/2014 | Chen-Ho | B42D 25/285 283/85 |
| 2015/0227829 | A1 * | 8/2015 | Finn | H01L 24/27 235/488 |
| 2016/0284582 | A1 * | 9/2016 | Dang | C08L 63/00 |
| 2018/0355215 | A1 * | 12/2018 | Dietze | C09J 5/00 |

FOREIGN PATENT DOCUMENTS

| | | | |
|---|---|---|---|
| CN | 101357553 | A | 2/2009 |
| CN | 101935014 | B | 1/2014 |
| DE | 197 54 068 | A1 | 6/1999 |
| DE | 103 38 732 | A1 | 3/2005 |
| DE | 10 2010 031 212 | A1 | 1/2012 |
| EP | 1306725 | A1 | 5/2003 |
| EP | 1324887 | B1 | 12/2004 |
| EP | 1 522 984 | A2 | 4/2005 |
| WO | 00/61364 | A1 | 10/2000 |
| WO | 01/59745 | A1 | 8/2001 |
| WO | 02/30677 | A1 | 4/2002 |

OTHER PUBLICATIONS

Chinese Office Action with Search Report in CN 201780027874.8, dated Jun. 11, 2020, with English translation of relevant parts.

* cited by examiner

FILM STRUCTURE WITH PROTECTION AGAINST MANIPULATION

CROSS REFERENCE TO RELATED APPLICATIONS

This application is the National Stage of PCT/EP2017/060210 filed on Apr. 28, 2017, which claims priority under 35 U.S.C. § 119 of German Application No. 10 2016 108 216.3 filed on May 3, 2016, the disclosure of which is incorporated by reference. The international application under PCT article 21(2) was not published in English.

The invention relates to a film structure having protection against manipulation and inscribable by action of a laser beam.

In many areas of application, it is necessary to equip articles with a manipulation-proof identification. In the automobile sector, for example, vehicles are provided with a type designation, for example an engine or chassis identification, which is assigned individually to a specific vehicle. Furthermore, vehicles are being increasingly labeled with environmental stickers, which classify the vehicle in a particular pollutant emission group.

Such markings have authenticity character and should therefore be designed to be manipulation-proof. Film structures in the form of labels are often used for marking articles, since they are flexible and can be easily bonded adhesively on a substrate. To prevent the authenticity marking from being manipulated, it must be ensured that it is impossible for a counterfeiter to detach the film structure with the authenticity character from a substrate on which the film structure is affixed and to transfer it to another article without showing evidence of the counterfeiting. For this purpose, it is necessary that the destruction of the film structure be ensured in the case of a manipulation attempt.

One concern for the present invention is to specify an inscribed film structure with protection against manipulation that on the one hand can be easily affixed on an object to be identified and with which it is ensured that the film structure will be destroyed by a manipulation attempt.

One configuration of a film structure with protection against manipulation is specified in claim 1. The film structure comprises a top film and a laser-inscribable layer, which is disposed on the underside of the top film. Furthermore, the film structure comprises a bottom film and a bonding layer for bonding the bottom film with the top film and the laser-inscribable layer. The bonding layer is disposed between the laser-inscribable layer and the bottom film. The film structure has an inscribed region and a non-inscribed region. In the inscribed region of the film structure, the top film is fused together with the bottom film.

According to the film structure specified above, the laser-inscribable layer is disposed on the underside of the top film. The laser-inscribable layer is a layer that becomes ablated under the action of the energy of a laser beam. As an example, the laser-inscribable layer may be a metallization layer, which is affixed directly onto the underside of the top film during manufacture of the film structure. As an example, the laser-inscribable layer may be vapor-deposited or sputtered onto the underside of the top film. According to one possible embodiment, the laser-inscribable layer may be designed as an aluminum layer, especially an aluminum layer with a black color.

By the fact that the laser-active or laser-inscribable layer is metalized on the underside of the top film and not affixed onto the top side of the bottom film during the manufacture of the film structure, interactions occur between the bonding layers, especially during the laser inscription. Since the laser-inscribable layer is affixed directly onto the underside of the top film, the thermal energy generated by the laser beam acts directly on the laser-inscribable layer and is not reduced due to absorption by further layers, for example by the bonding layer.

Due to the laser inscription, on the one hand the metallization of the laser-inscribable layer is partly removed or is transformed into a colorless substance, and thus an inscription is produced. On the other hand, during the laser action, an interaction that leads to a permanent composite between the individual layers takes place due to melting and/or welding processes in the composite between the top film, the laser-inscribable layer, the bonding layer and the bottom film. Especially at the edges/borders of the inscription, a fusion of the individual layers with one another takes place and extends into the entire inscribed region. By virtue of the fusion of the top and bottom films in the inscribed region of the film structure, it is no longer possible to separate the top film from the bottom film without tearing the film structure apart in the inscription regions.

Due to the intensification of the interaction between top and bottom films at the border between the inscribed and the non-inscribed region as a consequence of the laser marking, an improvement of the authenticity nature of the inscribed film structure is achieved in comparison with a film structure in which the laser-inscribable layer is affixed onto the bottom film, for example is vapor deposited on the upper side of the bottom film. A transfer of the top film together with the inscribed layer disposed on its underside is almost completely ruled out even for complex manipulation attempts of chemical or physical nature, since the film layer, by virtue of the fusion of the layers, will be torn apart in the attempt to separate the top film from the bottom film.

In order to facilitate tearing apart of the film structure, the bottom film may be provided with lines of weakness, for example stamped lines. Besides the assurance of a destruction of the film structure during a detachment attempt, neither the inscription quality nor the visual impression in the film structure is negatively influenced as a consequence of the security stampings in the bottom film.

Figure 2:
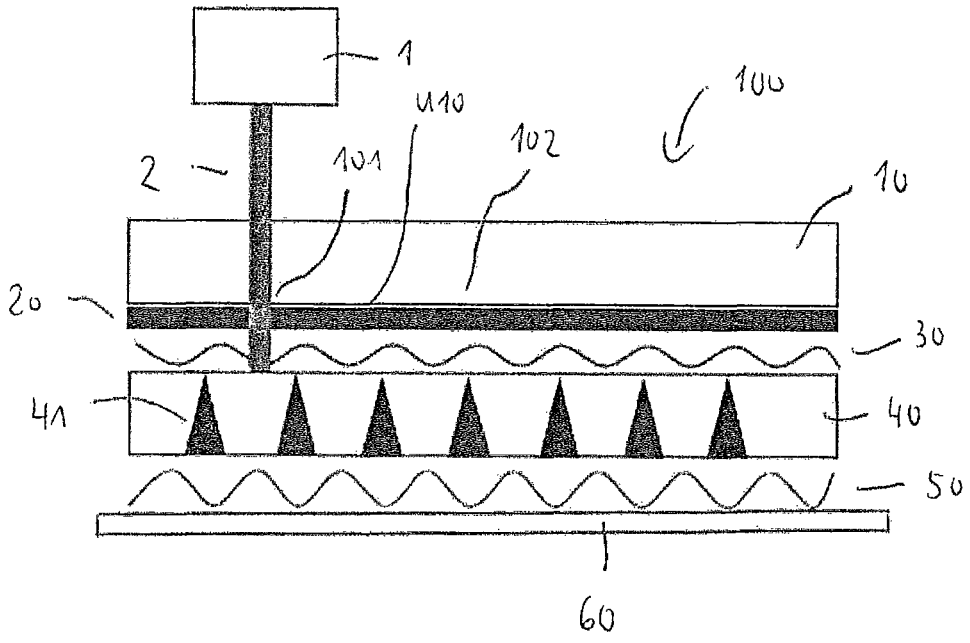
Figure 3:
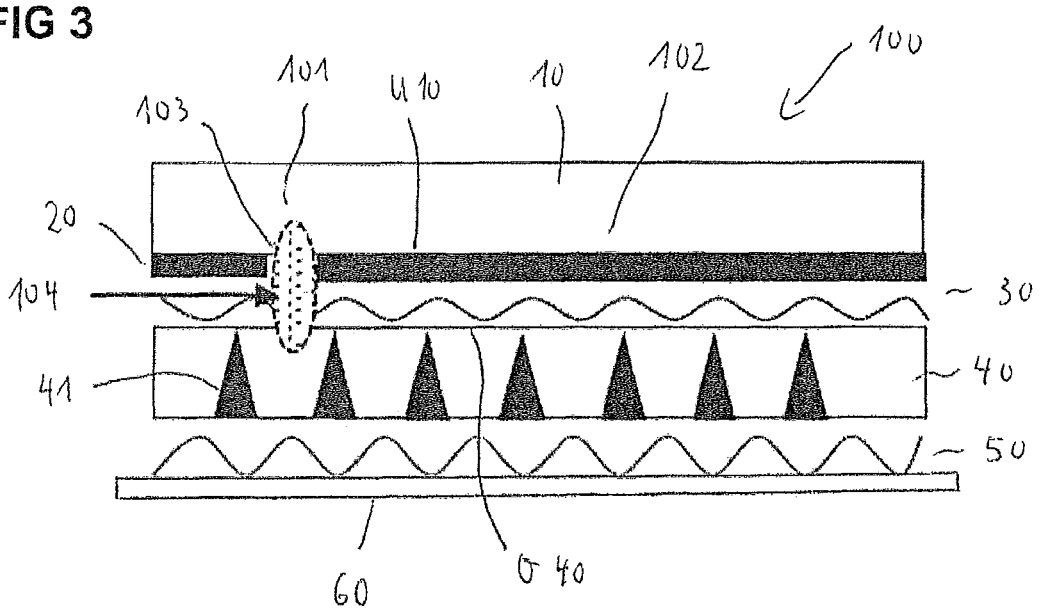
Figure 4:
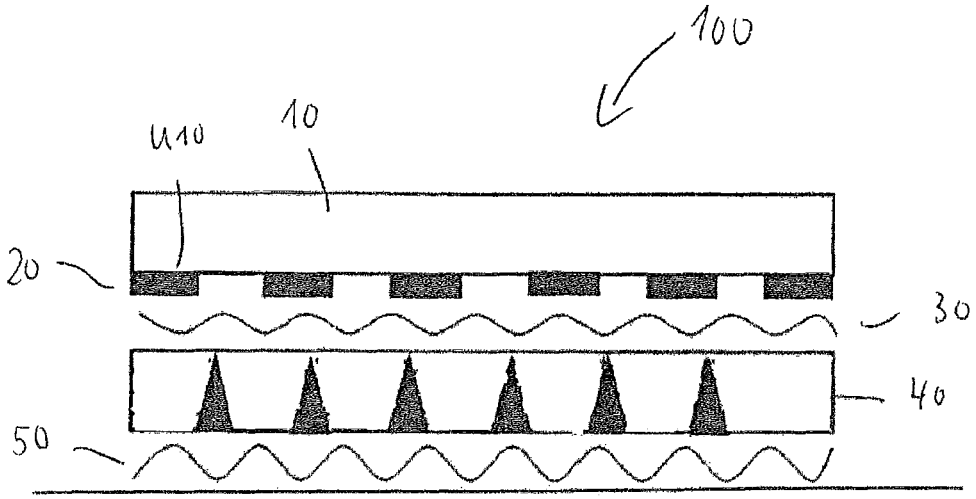
Figure 5:
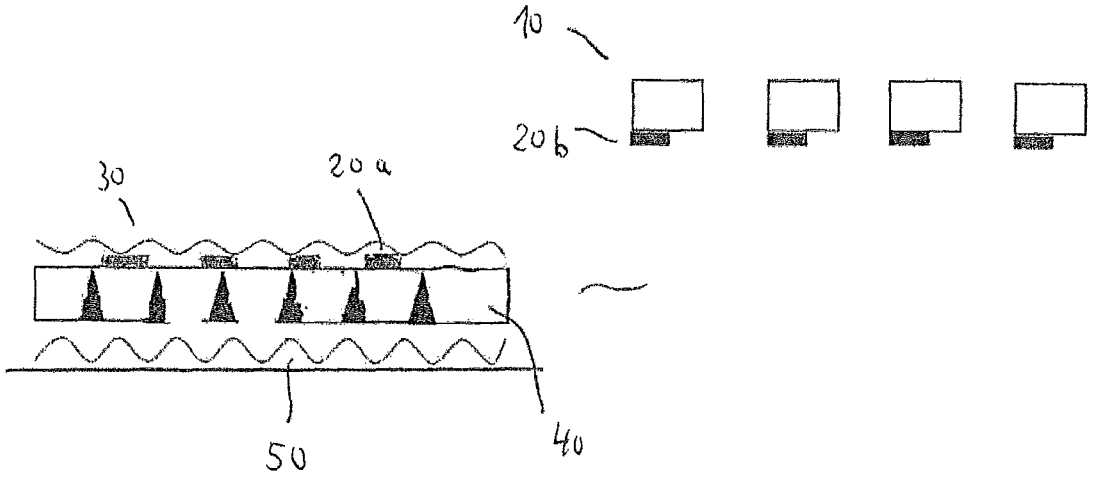

The invention will be explained in more detail in the following on the basis of figures, which show embodiments of the present invention, wherein:

FIG. 1 shows an embodiment of a film structure with protection against manipulation, FIG. 2 shows an action of a laser beam for introduction of an inscription in the film structure, FIG. 3 shows the film structure with protection against manipulation after the laser inscription step, with a melting region between the film courses, FIG. 4 shows the film structure with protection against manipulation after a laser inscription with a partial removal of the laser-inscribable layer, FIG. 5 shows a destruction of the film structure by fragmentation of the individual layers during a manipulation attempt.

FIG. 1 shows an embodiment of a film structure 100 with protection against manipulation. The film structure is designed as a so-called color laser film. It comprises a top film 10 and a laser-inscribable layer 20, which is disposed on the underside U10 of the top film 10. Furthermore, the film structure comprises a bottom film 40. The top film 10 as well as the bottom film 40 may be designed respectively as a layer of plastic, preferably of polyethylene (PE), polyethylene terephthalate (PET) or polyvinyl chloride (PVC).

A bonding layer 30 is provided for bonding the top film 10 and the laser-inscribable layer 20 disposed on its underside with the bottom film 40. The bonding layer 30 is disposed between the laser-inscribable layer 20 and the bottom film 40. The bonding layer 30 is disposed directly underneath the laser-inscribable layer 20 and directly above the bottom film 40. The bonding layer 30 may be, for example, a bonding adhesive.

The bottom film 40 may be provided with an adhesive layer 50 on its side U40 turned away from the bonding layer 30, i.e. on its underside. The adhesive layer 50 disposed on the underside U40 of the bottom film 40 is used for adhesive bonding of the film structure 100 onto a substrate. For protection of the adhesive layer 50, it may be covered by a carrier film 60.

The laser-inscribable layer 20 is affixed onto the underside U10 of the top film 10 and thus is permanently bonded with the top film 10. As an example, the laser-inscribable layer 20 may be vapor-deposited or sputtered onto the underside U10 of the top film 10. This means that, during the manufacture of the film structure, the laser-inscribable layer 20 is affixed not onto the bottom film 40 but instead onto the underside U10 of the top film 10, by a physical/chemical process. The laser-inscribable layer 20 may be affixed onto the underside U10 of the top film 10 in a thickness of smaller than 3 μm, preferably in a thickness between 0.1 μm and 0.4 μm.

The laser-inscribable layer 20 is designed in particular as a metallic layer, which is ablatable under the action of a laser beam. "Ablatable" will be understood to mean that the layer is eroded or destroyed by the action of a laser beam, especially by the thermal energy of the laser, so that it loses its opacity. The laser-inscribable layer 20 may be designed in particular as an aluminum metallization, which is disposed on the underside U10 of the top film 10. The aluminum metallization adheres permanently to the underside U10 of the top film 10, for example by vapor deposition or sputtering.

The laser-inscribable layer may be designed in particular as an aluminum layer with a black color. For application of the aluminum layer 20 onto the underside U10 of the top film 10, the aluminum may be vaporized in a vacuum atmosphere and deposited on the underside U10 of the top film 10. Thereby a silver-colored coating is obtained on the underside U10 of the top film 10. The opacity of the coating is dependent on the thickness of the coating. The coating is transparent to opaque, depending on thickness of the layer. For generation of the preferably black metallization layer 20, oxygen is injected into the vacuum. Thereby nonstoichiometric aluminum oxide, which has a black color, is formed.

The top film 10 is preferably designed as a transparent layer in the film structure. The bottom film 40 may be configured as a white layer. In order to facilitate the tearing apart of the film structure in case of a manipulation attempt, for example an attempt to strip the film structure from a substrate, the bottom film 40 may be provided with at least one line of weakness 41. FIG. 1 shows the bottom film 40 with a plurality of lines of weakness 41, which are made, for example as a security stamping in the bottom film 40. According to an alternative configuration form, the bottom film may be provided with, instead of or in addition to the lines of weakness, easy-tearing materials such as security films of acrylate, polyurethane and similar.

FIG. 2 shows the film structure 100 with protection against manipulation during an inscription by means of a laser 1. By action of its laser beam 2 on the laser-inscribable layer 20, the laser generates an inscription within the film structure 100. Inscription will be understood to mean graphic symbols and characters of any kind. As is obvious on the basis of FIG. 2, the film structure 100 has an inscribed region 101 and a non-inscribed region 102 as a consequence of the laser inscription. Due to the action of the laser beam, the laser-inscribable layer 20 is ablated. This means that it is partly removed or transformed into a colorless substance in the inscribed region 101 of the film structure 100, while it remains intact in the non-inscribed region 102. The layer thickness of the laser-inscribable layer 20 is therefore reduced in the inscribed region 101 of the film structure in comparison with the non-inscribed region 102. As an example, only individual particles of the laser-inscribable layer 20 are still present in the inscribed region 101 of the film structure.

Since the region in which the inscription takes place is sealed between the top film 10 and the bottom film 40, no health-endangering and environmentally polluting emissions to the outside occur during inscription of the film structure 100 with the laser beam 2. The film structure 100 thus offers high-level intrinsic protection of the registered inscription pattern against chemical and mechanical aggressions.

FIG. 3 shows the film structure 100 after action of the laser beam 2 for inscription of the film structure. By virtue of the energy input due to the laser beam 2, the top film 10 and the bottom film 40 are fused with one another at the melting region 104 illustrated within the inscribed region 101 in FIG. 3. Since the laser-active/inscribable layer 20 is affixed directly on the top film, i.e. on the underside U10 of the top film 10, more heat is generated locally in this region than if the laser-active/laser inscribable layer 20 had been affixed onto the upper side O40 of the bottom film 40 during the manufacture of the film structure.

The heating developed in this region during the laser marking on the basis of the energy input by the laser beam leads to a melting together of the respective materials of the top film 10, of the laser-inscribable layer 20, of the bonding layer 30 and of the bottom film 40. Thereby a conglomerate comprising the top film 10, the laser-inscribable/laser active layer 20, the bonding layer 30 and the bottom film 40 fused together with one another is formed in the melting region 104 of the film structure 100.

The bottom film 40 absorbs the laser energy of the laser 1 efficiently during the laser inscription, whereby a melting of the bottom film 40 together with the other layers, especially the top film 10, is made possible. In addition, the bonding layer 30 becomes mobile due to the heat input as a consequence of the laser action and thus likewise intensifies the interactions between the top film 10, the laser-inscribable layer 20 and the bottom film 40 due to an enlargement of the local contact face and a mixing with the resulting melt.

Due to the fusion, in the melting region 104, of the bottom film 40 with the top film 10 and the laser-inscribable layer 20 affixed onto its underside U10, a local strengthening of the adhesive force results in the film composite 100 in the region containing the inscription after the laser action. Furthermore, a weakening of the structure of the top film 10 takes place due to the melting of the materials, thus facilitating a further tearing of the film during an attempt to separate the individual film layers from one another.

The interactions between the top film 10, the laser-inscribable layer 20, the bonding layer 30 and the bottom film 40 occur in the region in which the laser beam acts on the film structure, i.e. in the region inscribed after the laser action. At a border 103 between the inscribed region 101 and the non-inscribed region 102, i.e. at the edge of the inscription, a change of the interaction, especially of the adhesion, takes place between the top film 10, the laser-inscribable layer 20, the bonding layer 30 and the bottom film 40. The change of the interaction has the consequence that the top film 10 and the bottom film 40 fuse together with one another in the inscribed region 101, and in the non-inscribed region 102 of the film structure they are not fused together with one another but instead are separated from one another by the intact laser-inscribable layer 20 and the bonding layer 30. Furthermore, in the non-inscribed region 102 of the film structure, the laser-inscribed layer 20 is separated from the bottom film 40 by the bonding layer 30.

FIG. 4 shows the film structure 100 after the inscription as a consequence of the laser action. The laser-inscribable layer 20 has been partly removed or transformed into a colorless substance in the inscribed region 101 of the film structure. In contrast, the laser-inscribable layer 20 in the non-inscribed regions 102 of the film structure continues to adhere to the underside U10 of the top film 10.

FIG. 5 shows how the film structure 100 is torn apart in the attempt at a manipulation, especially a separation between top and bottom films. Fragments 20*a* of the laser-inscribable layer 20 remain adhering on the bottom film as a consequence of the fusion with the bottom film 40, whereas other parts 20*b* of the laser-inscribable layer 20 adhere to the top film 20. Thus the film structure ensures that, as a consequence of the melting together and fusion of the individual layers, the top film and the bottom film can no longer be separated from one another nondestructively after the inscription of the laser-inscribable layer 20, whereby an improved authenticity nature of the film structure is achieved.

LIST OF REFERENCE SYMBOLS

1 Laser
2 Laser beam
10 Top film
20 Laser-inscribable layer
30 Bonding layer
40 Bottom film
50 Adhesive layer
60 Carrier film
100 Film structure

The invention claimed is:

1. A film structure with protection against manipulation, comprising:

a top film (10), a laser-inscribable layer (20), which is affixed onto the underside (U10) of the top film (10) and thus is permanently bonded with the top film (10), a bottom film (40) being a layer of plastic, a bonding layer (30) for bonding the bottom film (40) with the top film (10) and the laser-inscribable layer (20), wherein the bonding layer (30) is disposed between the laser-inscribable layer (20) and the bottom film (40) in a manner such that the bonding layer (30) is disposed directly underneath the laser-inscribable layer (20) and directly above the bottom film (40) and there is no intermediate layer at any point between the bonding layer (30) and the bottom film (40), and there is no other intermediate layer between the bonding layer (30) and the laser-inscribable layer (20), wherein the film structure (100) has an inscribed region (101) and a non-inscribed region (102), wherein the top film (10) is fused together with the bottom film (40) in the inscribed region (101).

2. The film structure according to claim 1, wherein an interaction between the top film (10), the laser-inscribable layer (20), the bonding layer (30) and the bottom film (40) at a border (103) between the inscribed region (101) and the non-inscribed region (102) of the film structure is changed.

3. The film structure according to claim 2, wherein the top film (10) and the bottom film (40) are separated from one another in the non-inscribed region (102).

4. The film structure according to claim 1, wherein the top film (10) in the non-inscribed region (102) of the film structure is separated from the bottom film (40) by the laser-inscribable layer (20) and the bonding layer (30).

5. The film structure according to claim 1, wherein the laser-inscribable layer (20) has been at least partly removed in the inscribed region (101) of the film structure.

6. The film structure according to claim 1, wherein the layer thickness of the laser-inscribable layer (20) is reduced in the inscribed region (101) of the film structure in comparison with the non-inscribed region (102).

7. The film structure according to claim 1, wherein the laser-inscribable layer (20) is vapor-deposited or sputtered onto the underside (U10) of the top film (10).

8. The film structure according to claim 1, wherein the laser-inscribable layer (20) is a metallic layer, which is ablatable due to the action of a laser beam (2).

9. The film structure according to claim 1, wherein the laser-inscribable layer (20) comprises an aluminum metallization layer on the underside (U10) of the top film (10).

10. The film structure according to claim 1, wherein the laser-inscribable layer (20) comprises an aluminum layer with a black color.

11. The film structure according to claim 1, wherein the top film (10) comprises a transparent layer in the film structure.

12. The film structure according to claim 1, wherein the bottom film (40) comprises a white layer.

13. The film structure according to claim 1, wherein the bottom film (40) has at least one line of weakness (41).

14. The film structure according to claim 1, wherein an adhesive layer (50) for adhesive bonding of the film structure onto a substrate is disposed on the side (U40) of the bottom film (40) turned away from the bonding layer (30).

* * * * *